US006003682A

United States Patent [19]

Bielagus

[11] Patent Number: 6,003,682

[45] **Date of Patent: *Dec. 21, 1999**

[54] BAR SCREEN DRIVE SYSTEM

[75] Inventor: Joseph B. Bielagus, Tualatin, Oreg.

[73] Assignee: Beloit Technologies, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,392

[22] Filed: Dec. 26, 1996

[51] Int. Cl.[6] ..... B07B 1/49

[52] U.S. Cl. ..... 209/674; 209/394; 209/395

[58] Field of Search ..... 209/365.4, 393, 209/394, 395, 396, 659, 660, 674

[56] References Cited

U.S. PATENT DOCUMENTS

| | | | |
|---|---|---|---|
| 1,606,301 | 11/1926 | Jones | 209/674 |
| 2,443,176 | 6/1948 | Banning | 209/395 |
| 3,300,921 | 1/1967 | Middendorf . | |
| 4,504,386 | 3/1985 | Dyren et al. | 209/396 X |
| 5,305,891 | 4/1994 | Bielagus | 209/396 |
| 5,392,930 | 2/1995 | Jones | 209/674 |
| 5,392,931 | 2/1995 | Bielagus | 209/674 |
| 5,398,819 | 3/1995 | Cormack et al. . | |
| 5,476,179 | 12/1995 | Jones et al. | 209/674 |
| 5,560,496 | 10/1996 | Lynn . | |

FOREIGN PATENT DOCUMENTS

| | | |
|---|---|---|
| 259-963 | 3/1988 | European Pat. Off. . |
| 53-71258 | 6/1978 | Japan . |
| 54-67386 | 10/1981 | Japan . |
| 58-178384 | 11/1983 | Japan . |
| 59-199085 | 11/1984 | Japan . |
| 60-28080 | 2/1985 | Japan . |
| 4-134471 | 12/1992 | Japan . |
| 5-192642 | 8/1993 | Japan . |
| 1641469 | 4/1991 | U.S.S.R. . |
| PCT/SE86/00585 | 7/1987 | WIPO . |
| WO 94/02261 | 2/1994 | WIPO . |
| WO 95/01918 | 1/1995 | WIPO . |

OTHER PUBLICATIONS

Derwent Machine–Assisted Translation of JP53071258.85

"DynaGage™ Bar Screen . . . high performance chip thickness screening." Radar Companies.

*Primary Examiner*—Tuan N. Nguyen
*Attorney, Agent, or Firm*—Lathrop & Clark LLP

[57] ABSTRACT

Two racks of parallel screening bars each have rigid rack frames which extend beneath the bars. Two crankshafts with offset cam surfaces are mounted to the machine frame, and the rack frames are mounted by bearings to the crankshaft cam surfaces. The rack frame bearings are closely spaced beneath the bars to balance the system, while the rack frames provide a stiff oscillatory platform for the bars, permitting narrow gauge bars and increased screening area. The rack frames also include counterweights to dynamically balance the system.

21 Claims, 5 Drawing Sheets

BAR SCREEN DRIVE SYSTEM

FIELD OF THE INVENTION

The present invention relates to apparatus for screening particulate matter such as wood chips and municipal trash in general and relates to bar screen apparatus in particular.

BACKGROUND OF THE INVENTION

Bar screens have proven particularly valuable in sorting materials which have unequal dimensions. Wire or punched screens are typically used to sort materials of a granular nature in which all three dimensions are approximately equal. However, many classes of objects, including two of particular commercial interest, wood chips and municipal or industrial trash, are not readily amenable to separation by conventional screening processes.

In the manufacture of paper, logs are reduced to wood chips by chipping mechanisms, and the chips are cooked with chemicals at elevated pressures and temperatures to remove lignin. The chipping mechanisms produce chips which vary considerably in size and shape. For the cooking process, which is known as digesting, it is desirable that the chips supplied have a uniform thickness in order to achieve optimal yield and quality. Ideally, the supplied chips will allow production of a pulp which contains a low percentage of undigested and/or over-treated fibers. Thus, a means is needed to separate chips on the basis of thickness rather than any other dimension. Bar screens have proven particularly adept at separating materials based on a single dimension such as thickness.

With the rise in the recycling culture, a strong demand for an apparatus for separating municipal and industrial trash into its constituent components for recycling has developed. Conventional separation systems which utilize rotating screen drums have proved ineffective. Municipal trash typically contains a certain portion of stranded material and sheet-like materials which tend to clog screens. Further, the tumbling action of screens can result in the breakage of components of the municipal waste stream such as glass bottles thereby increasing the difficulty of recycling them.

Bar screens consist of two sets of generally rectangular bars which are joined together in an array of racks. The two sets of bars are interleaved to form a screening bed. The bed consists of the elongated, rectangular bars and the narrow, rectangular spaces between the bars. Material to be sorted is introduced to the surface of the bed and the bars are caused to oscillate so that when one set of bars is going up, the other set is going down. This oscillatory motion tends to tip wood chips or other relatively small planar objects on edge so that those of a given thickness may slide through the gaps between the bars. Alternatively, it has been found when separating office waste paper, that bar screens prove effective in removing extraneous litter from the recovered office paper.

If the limitations of current bar screens could be overcome, the utility of the bar screen, already a valuable tool in the pulp industry and in the recycling industry, would be greatly increased. The first limitation relates to capacity. It is always desirable in a screening apparatus to increase the rate at which materials may be fed over the screen and yet be properly processed by the screen. In the case of bar screens, the existing capability of a given screen is dependent on the total area of the screening bed and more particularly the area of the gaps between the bars through which the separated material must pass. Thus, it would be advantageous to increase both the size of a bar screening unit and the total open area between bars. In current bar screens sets of bars are mounted on shafts which are driven eccentrically. Eccentric shafts, however, can only be of a limited length before the bending loads on the shafts cause excessive bearing wear. Further, the narrow screening bars tie together structurally the eccentric shafts. Hence increasing the screen open area by reducing the width of the bars is impractical because of the resultant reduction in structural stiffness of the bars.

Other areas of possible improvement in bar screens are associated with the desirability of maintaining strict timing between the eccentric drives of each set of bars so that they are maintained at a consistent 180 degrees out of phase relation.

Lastly, reduced maintenance and improved ease of maintenance are always desirable in industrial machinery, particularly those which must function in a dirty environment.

What is needed is a bar screen of increased capacity, improved timing linkages, and lower maintenance costs.

SUMMARY OF THE INVENTION

The bar screen of this invention has a machine frame on which is mounted a motor which drives a first crank shaft. The first crank shaft extends across and beneath the bars of a screen bed. A second crank shaft is spaced parallel to the first crank shaft and is driven by a timing belt which connects the first and second shafts. The second crank shaft also extends under the screening bed. Each crank shaft has two pairs of cam surfaces positioned near the shaft ends on either side of the screen bed. Thus the two crank shafts have eight cam surfaces. The inner four cam surfaces comprise an inner cam set. An outer cam set is formed by the four outer cam surfaces which are spaced outwardly of the inner cam surfaces. Each pair of inner cam surfaces on either end of the crank shafts supports a single inner drive beam. Likewise each pair of outer cam surfaces supports a single outer drive beam. The drive beams are supported on the cam bearings. Thus, on each crank shaft end there is an inner drive beam and an outer drive beam which ride on the inner and outer cam surfaces and are driven to oscillate 180 degrees out of phase with respect to each other.

The inner drive beams are on either end of the crank shafts and are thus spaced on either side of the screen bed and are joined by two spaced apart bar support beams. A first set of screening bars are mounted by depending legs to the bar support beams mounted on the inner drive beams. Similarly a second set of screening bars are mounted by depending legs to support beams which join the outer drive beams.

The first crank shaft is driven by the motor through a speed reducer. The second shaft is driven by a timing belt which extends between the first crank shaft and the second crank shaft. The rotating crank shafts cause the inner and outer drive beams to oscillate 180 degrees out of phase. The oscillating drive beams cause the bar support beams and the screening bars of the first and second racks to oscillate. The oscillating racks define a screen bed.

Each bar's depending legs are clamped into a fixture which mounts the legs to one of two bar support beams which interconnect two drive beams. In order to maximize the open area of the screen bed, the bars are approximately one-quarter inch thick and thus the legs, which are of equal thickness, are clamped and locked by retention bars which interfit with projections on each of the bar legs.

Each bar has two depending legs which are mounted either to the outer support beams or the inner support beams The bar extends between the support beams and typically extends beyond the support beams to a section of bar which is cantilevered to one side of the portion of the bar between the support beams. The cantilevered sections of the support bars benefit from being joined together to control the spacing of the bars and to add rigidity to each rack of bars which makes up the bar screen deck. The cantilevered portions of the bars have short depending legs. For ease of assembly, the cantilevered legs of the bars have canted slots which receive a clamping bar which clamps screen bars together.

It is a feature of the present invention to provide a bar screen which is adaptable to screen decks of greater width.

It is a further feature of the present invention to provide a bar screen which facilitates the use of bars of thinner gauge.

It is a yet further feature of the present invention to provide a bar screen which can process wood chips or industrial or municipal waste.

It is yet another feature of the present invention to provide a bar screen having lower maintenance costs.

It is a still further feature of the present invention to provide a bar screen wherein the two interleaved racks are kept in fixed oscillatory phase relation.

It is an additional object of the invention to provide a dynamically balanced bar screen.

Further objects, features, and advantages of the invention will be apparent from the following detailed description when taken in conjunction with the accompanying drawings.

DESCRIPTION OF THE PREFERRED EMBODIMENTS

Figure 1:
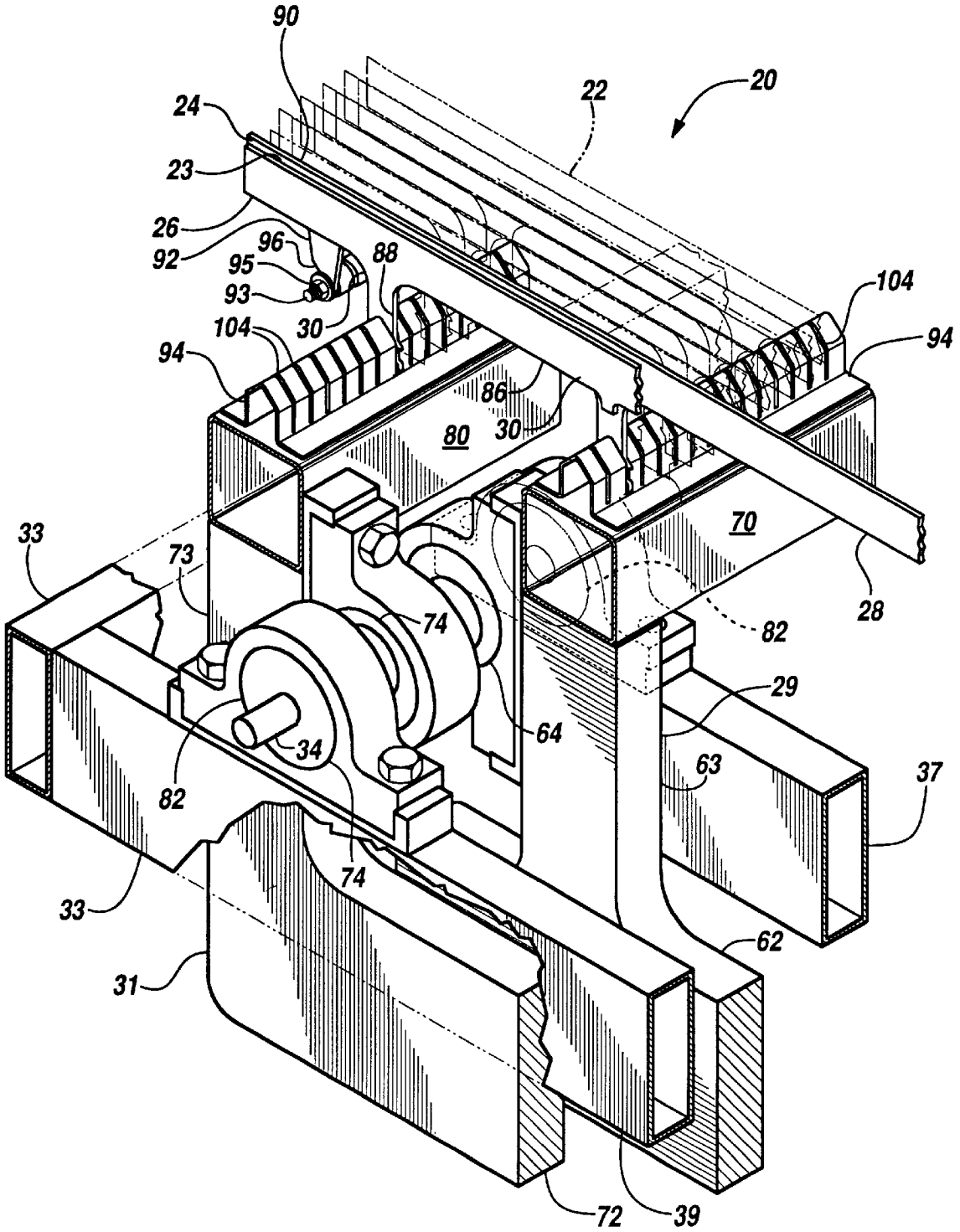
FIG. 1 is a fragmentary isometric view of the bar screen of this invention.
Figure 2:
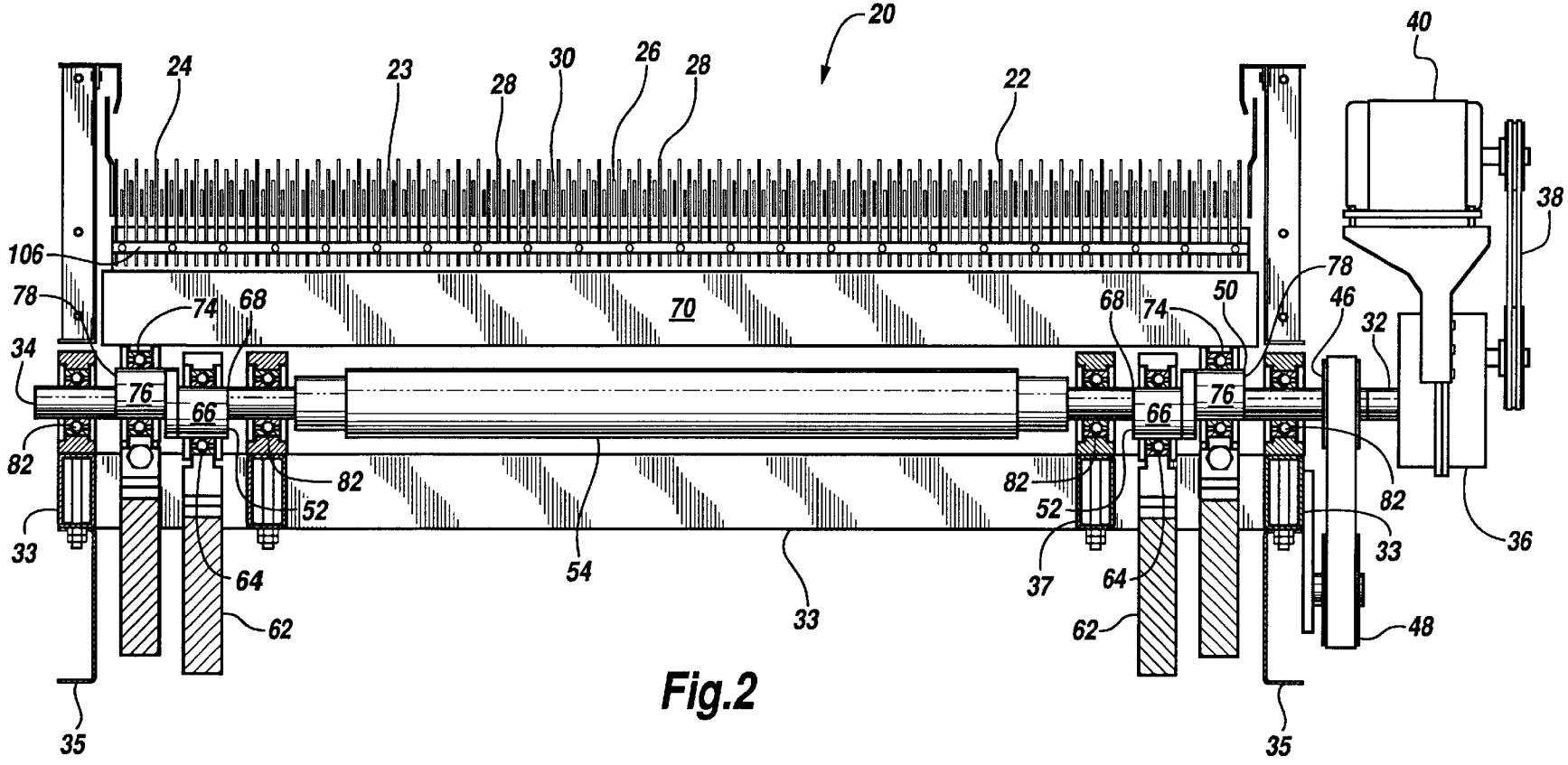
FIG. 2 is a front elevational view partly cutaway of the bar screen of FIG. 1.

Referring more particularly to FIGS. 1–5 wherein like numbers refer to similar parts, a bar screen 20 is shown in FIG. 2. Two racks 24, 26 of uniform narrow horizontal bars are moved with respect to one another to define a screen deck 22 with uniform spacing between adjacent bars. Material disposed on the screen deck 22 is agitated and advanced by the motion of the racks such that material of the selected minimum dimension is is allowed to pass through the gaps 23 defined between parallel bars in the deck. Oversize material is advanced along the deck 22 and discharged to a subsequent bar screen or an end conveyor. The first rack 24 and the second rack 26 are substantially the same in construction, and are each assemblies of an array of parallel narrow width screening bars 28, 30. The proper spacing between bars in a rack is established by fixing two downwardly extending legs 88 of each bar in two parallel retention brackets 94 which run perpendicular to the bars. Although the bars 28 within a rack 24 are uniform, they are positioned at two heights above the retention brackets 94 by having legs 88 of two different lengths. The bars 28 within a rack thus alternate in spacing from the retention brackets 94, as set forth in U.S. Pat. No. 5,305,891, the disclosure of which is herein incorporated by reference.

Figure 6:
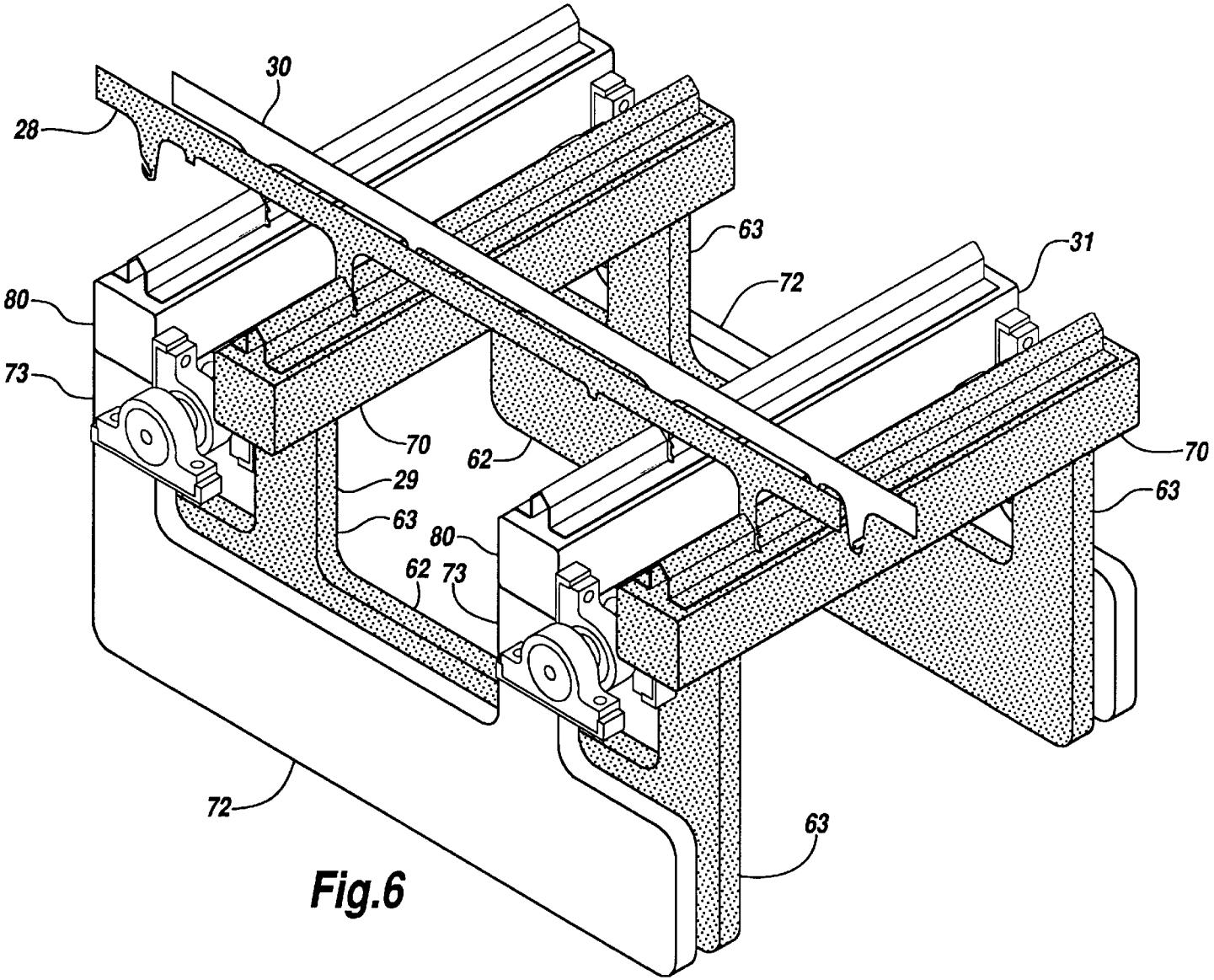
FIG. 6 is a simplified schematic view of the relationship between the first rack and the second rack of the bar screen of FIG. 1 which define the bar screen screening deck.

As best shown in FIG. 6, the bars 28, 30 of the first rack 24 and the second rack 26 are mounted by the retention brackets 94 to rigid oscillating rack frames 29, 31. Each rack frame has two parallel tubular support beams 70, 80 which extend perpendicular to the screening bars and which pass beneath all the bars in a rack, Each support beam 70, 80 is connected by two vertical posts 63, 73 to two spaced parallel drive beams 62, 72. The drive beams 62 extend parallel to the screening bars and serve to connect the forward support beam to the rearward support beam in each rack frame 29, 31. The inherent stiffness of the rack frames 29, 31, which are formed or tubular or solid members on the order of 8 inches on a side, insures that the screening bars will not be inordinately bent or deformed. Because the relationships between the screening bars is maintained by the rack frames, the bars themselves may be made of thinner gage stock, on the order of ¼ inch, and hence the space of the screen deck 22 may be devoted to more gaps 23, promoting increased screening capacity.

The rack frames 29, 31 are mounted to the machine frame 33 by bearings which ride on a first crank shaft 32 and a second crank shaft 34. The machine frame 33 has an inner member 37 and an outer member 39 on each side, The crank shafts 32, 34 are supported on bearings 82 on each end which are mounted to the frame inner members 37 and the frame outer members 39. The first rack frame 29 is mounted to the inside of the second rack frame 31. The first crank shaft 32 is connected to a speed reducer 36 which is driven by a belt 38 from a drive motor 40. The second crank shaft 34 is driven by a timing belt 42 which connects drive pulleys 44, 46 and an idler pulley 48. As shown in FIG. 2, the second crank shaft 34 has a drive side crank 50 joined by a shaft 54 to an end crank 52. Similarly the first crank shaft 32 has a driven crank (not shown) and an end crank (not shown) connected by a shaft (not shown).

The first, inner, rack frame 29 has bearings 64 which ride on inner cam bearing surfaces 66 on eccentric cams 68 of the crank shafts 32, 34. The first rack frame bearings 64 are closely spaced beneath the screening bars, and are connected to the support beams 70 and the posts 63 of the first rack frame 29. The motion of the first rack frame 29 on the cams 68 causes the bars 28 to oscillate up and down.

Similarly the second, outer, rack frame 31 is mounted to bearings 74 which ride on outer cam bearing surfaces 76 on eccentric cams 78 defined by the cam shafts 32, 34. When the crank shafts 32, 34 are turned by the motor the bars in each rack follow an oscillating pattern dictated by the eccentric cams 68, 78 which are 180 degrees out of phase. Each cam surface is preferably a right conic surface which has an axis which is offset from the axis of the crank shaft on which the surface is formed.

The two halves of the bar screen 20 consisting of the first rack 24 of bars 28 and the second rack 26 of bars 30 together with their associated rack frames 29, 31, are balanced. Thus when one rack is moving up the other rack is moving down 180 degrees out of phase with the other. The timing belt 42 creates a single statically balanced system by linking the two halves of the bar screen 20. However each rack of bars and its support structure is not by itself balanced. However, the racks are mounted and constructed to minimize imbalances to the system resulting from the oscillating motion of the racks and rack frames.

The fact that the amount of effort required to rotate a rack of bars through one complete cycle varies depending on whether the rack is moving up against gravity, or down with gravity is addressed by the use of the timing belt 42. During a single 360 degree cycle the second rack 26 while driven by the timing belt 42 is accepting energy from the belt 42 as it moves up against gravity, and is supplying energy as it moves down with gravity. Because the supplied energy is transmitted through the belt in a direction which is opposite the direction of the accepted energy the second rack during its downward motion tries to push on the belt.

A belt can only transmit forces in tension thus it is the tension in the timing belt 42 which pulls the second rack up against gravity. When gravity acts with the rack the tension load must switch from the portion of the belt leading away from the drive pulley 46 on the second rack to the portion of the belt 42 leading towards the driving pulley 44. Yet pushing on a belt is not possible, and dynamic oscillations would result from reversing the portion of the belt which is in tension. The bar screen 20 smooths this transition by utilizing an extremely strong Kevlar reinforced belt with essentially zero elasticity which is pretensioned so that when the second rack is moving downwardly the direction of tension remains constant but the magnitude of the tension force varies. The pretensioning of the belt 42 is accomplished by moving the idler pulley 48 perpendicular to the path of the belt and locking the idler pulley 48 in position.

The timing belt has teeth (not shown) which engage with corresponding teeth (not shown) on the drive pulleys 44, 46 causing the two racks to remain in precise synchronization. The belt teeth (not shown) prevent slipping of the belt 42 on the drive pulleys. If the bar screen 20 becomes jammed the motor belt 38 will slip or the motor 40 will stall. The racks will nonetheless remain mechanically synchronized by the timing belt 42.

Vibration produced by the dynamic imbalance of each rack of bars and its support frame is also a concern. Because the components of the bar screen 20 are not infinitely stiff—even though the joined first and second racks of bars are dynamically balanced—vibration caused by the dynamic loads in each rack could be produced. To minimize these vibrations, each rack of bars is balanced so that the center of gravity of each rack and its rack frame is substantially centered on the axis of the support bearings 64, 74. Each cam has a center which is spaced from the axis of the shaft to which it is mounted. The center of gravity of each combined rack and rack frame is positioned approximately in a plane extending through the centers of the cams on which the rack frame is mounted. As an approximation, the center of gravity of each combined rack and rack frame is positioned approximately in a plane extending through the two shafts.

Figure 4:
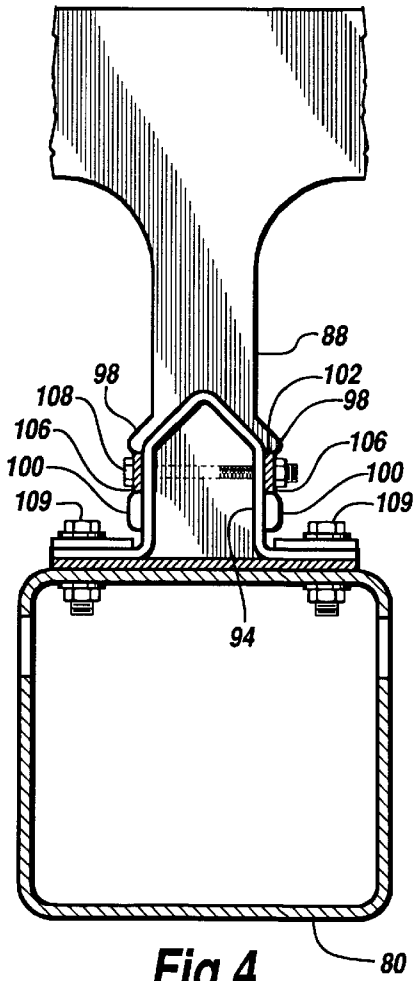
FIG. 4 is an enlarged fragmentary view of the screen bar mount employed in the bar screen of FIG. 1

Balancing the racks 24, 26 about the support bearings 64, 74 is accomplished as shown in FIGS. 2 and 4 by placing the support bearings 64, on the vertical posts 63 which extend between the drive beams 62 and the support beams 70, and likewise by placing the support bearings 74 on the vertical posts 73 which extend between the drive beams 72 and the support beams 80. This places the axis of the support bearings 64, 74 as close to the screen bars 28, 30 as possible. Secondly the drive beams 62, 72 are constructed of solid steel section which extends nearly to the base flange 35 of the frame 33 of the bar screen 20. The solid sections act as counterweights dynamically balancing each rack of bars 28, 30.

Figure 3:
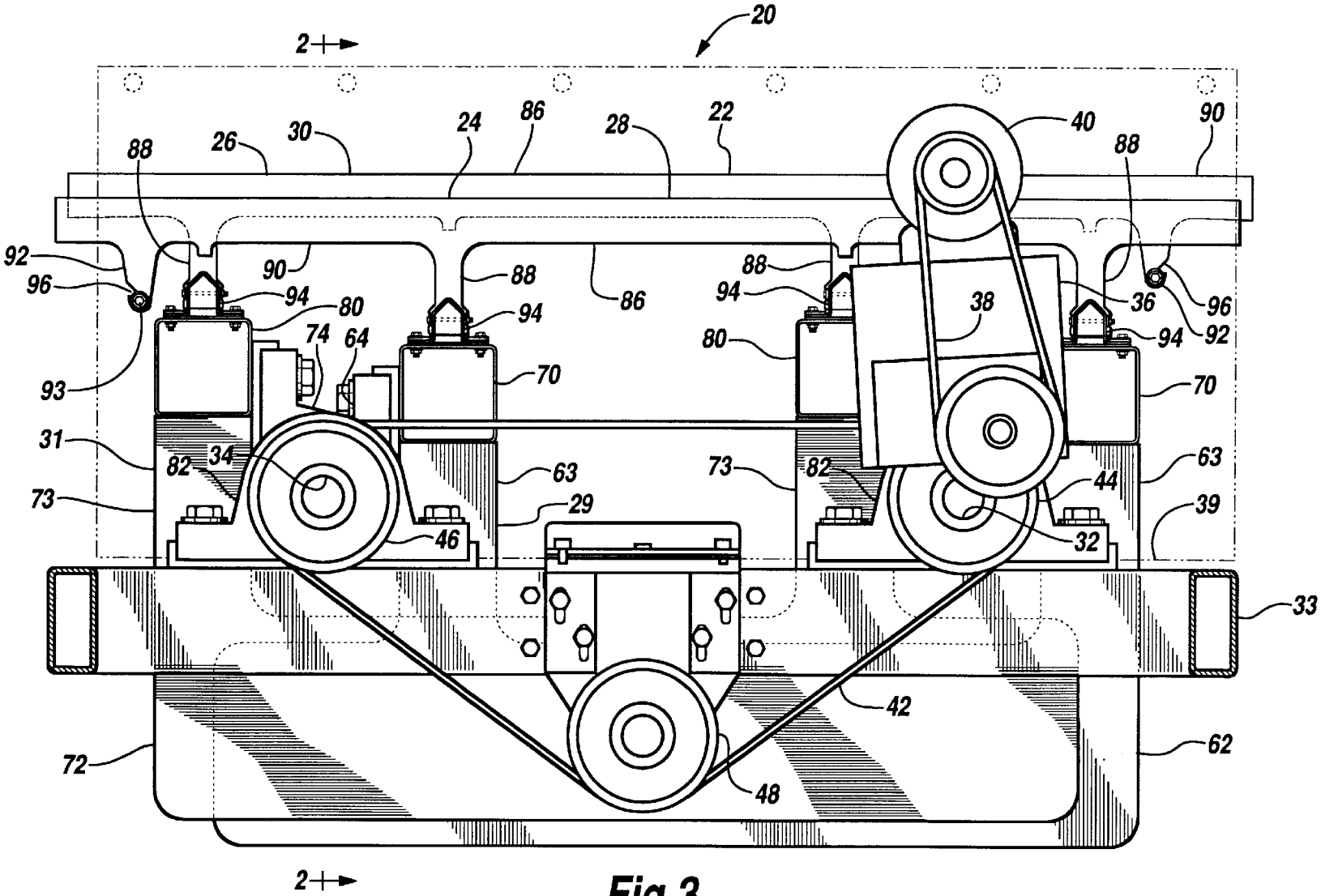
FIG. 3 is a side elevational view of the bar screen of FIG. 1

Each bar 28, 30 of each rack 24, 26 has an unbroken top surface and has two depending support legs 88. As shown in FIG. 1–3, the bars 28, 30 have a supported section 86 between the two legs 88 and a cantilever section 90 which extends away from the supported section 86. The cantilever sections 90 have downwardly extending short legs 92, which are shorter than the support legs 88. The short legs 92 have an upwardly opening canted slot 96 shown in FIG. 3. A threaded rod 93 is received within the aligned slots 96 of the bars of one rack, with spacers positioned between each pair of bars in a single rack. A nut 95 on the end of the rod 93 clamps the cantilevered sections and spacers together. The short legs 92 and thus the cantilevered sections 90 of the racks 24, 26 are held in fixed spaced relation by the threaded rods 93 and spacers (not shown) between adjacent bars thus stabilizing the cantilevered sections 90.

As shown in FIGS. 1 and 2, the parallel bars 28 of the first rack 24 interdigitate or interleave with the bars 30 of the second rack 26. The motor and the crank shafts 32, 34 cause the bars 28 of the first rack 24 to oscillate vertically and in the lengthwise direction of the bars. The crank shafts 32, 34 also cause the bars 30 of the second rack 26 to oscillate in a similar fashion but 180 degrees out of phase or out of sync with the first rack. It is the oscillation of the bars 28, 30 of the first rack 24 and the second rack 26 together with a three degree slope of the screen deck 22 which causes the granular materials such as wood chips or municipal wastes to progress over the screen deck and for a portion of the material to pass through the screen deck.

In conventional bar screens, the bars of each rack have been mounted by their depending legs to drive beams which ride on eccentric shafts. In such bar screens, the use of eccentric shafts inside the bar drive beams has limited the practical width of the bar screen. As a bar screen is made wider, the eccentric shafts tend to deflect under the load imposed by the bar support beams which also deflect under the load of the bars and the material being sorted. The deflection of the eccentric beams can cause excessive wear on the eccentric shaft bearings.

By supporting the bars 28, 30 on support beams 70, 80 the weight of the bars and the material being sorted is concentrated over the crank shaft support bearings 82. The bearings 64, 74 which support the rack frames on the bearing surfaces 66, 76, can accommodate the limited deflection imposed.

As shown in FIG. 3, the motor 40 through the speed reducer 36 is drives the first crank shaft 32 and through the timing belt 42 drives the second crank shaft 34. The first crank shaft 32 and the second crank shaft 34 are thus linked together so that the inner four bearing surfaces 66 move in unison. Similarly, the outer bearing surfaces 76 move in unison 180 degrees out of sync with the inner cam surfaces 66. The cam surfaces 66, 76 support the rack frames, and by imparting a circular motion to the rack frames cause the vertical and machine direction movement of the interleaved racks 24, 26.

The bar screen is dynamically balanced as the first rack 24 and the second rack 26 are of equal weight and are driven 180 degrees out of phase. Hence, when the first rack 24 mounted on the first support beams 70 is being moved upwardly by the drive beams 62 which are driven by the inner bearings 64 on the inner bearing surfaces 66, the second rack 26 mounted on the second support beams 80 is being moved downwardly by the drive beams 72 which are driven by the outer bearings 74 on the outer bearing surfaces 76.

Another advantage of the drive train 40 over previous drive mechanisms for bar screens is that the two racks of bars which form the screen deck 22 are directly linked by the timing belt 42, assuring that the phase relationship between the oscillating racks of bars remains fixed. The timing belt 42 is designed to transmit the entire load which the motor can impose through the drive train. Thus, if any component of the system jams, the entire machine stops with the result that the drive belt 38 slips or the motor 40 stalls. The halting of the machine 20 prevents any serious damage to the overall machine. When the jam is cleared, the entire drive train remains in alignment so that the bars comprising the screen deck remain in their precisely 180-degree-out-of-phase oscillatory motion.

Because the bar screen 20 employs a single motor 40, problems of overloading one motor with respect to another or having two motors working against each other are eliminated.

As noted above, the inner drive beams 62 and the outer drive beams 72 perform an additional beneficial function in addition to driving the bar support beams 70 and 80 in oscillatory motion. The inner drive beams 62 tie the inner bar support beams 70 together structurally. Similarly, the outer drive beams 72 tie the outer bar support beams 80 together structurally. Thus, the screen bars 28, 30 are not required to perform the structural function which they must perform in conventional bar screens of tying together the bar support beams. Because the bars 28, 30 do not perform this structural function, they may be of thinner gauge. Conventional bar screens typically have screening bars of half an inch or greater in thickness, but the bar screen 20 makes practical screening bars having widths of only a quarter of an inch or less. For a given bar screen deck area, the use of thinner bars allows more bars to be used and consequently there are more screening gaps between bars. It is the spaces between bars or the open area of the screen deck 22 which in general governs the rate at which material can be sorted by a given bar screen. Thus the bar screen 20 provides a design which allows decks of greater area to be built and also allows greater open area for a given sized deck.

Figure 5:
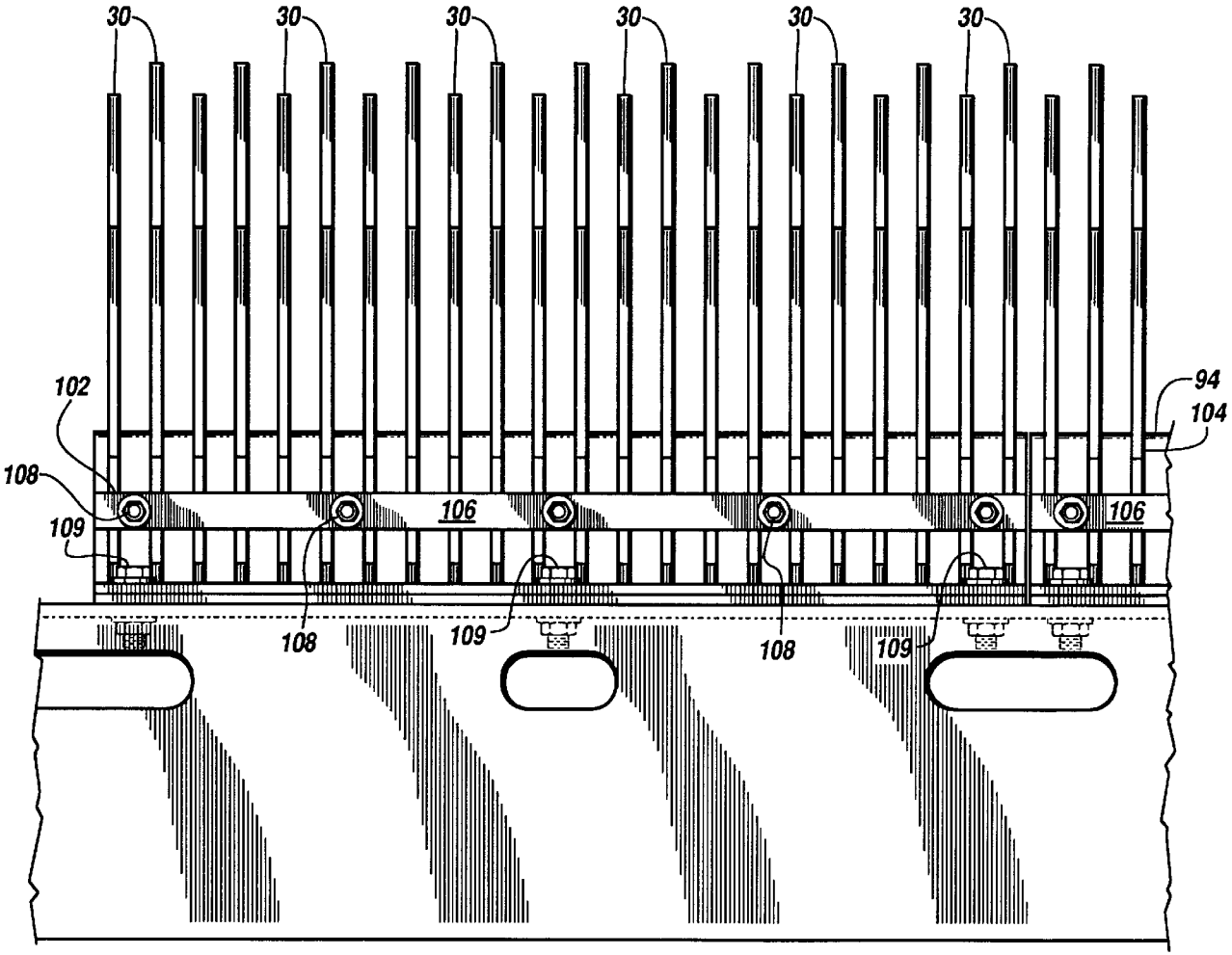
FIG. 5 is a cross-sectional view of the screen bar mount of FIG. 4 taken along section line 5—5.

The screening bars 28, 30, as best shown in FIGS. 1, 4 and 5 are supported for oscillating motion by the retention brackets 94 which are bolted to the bar support beams 70, 80. The bar legs 88 engage with the retention brackets 94. As shown in FIG. 4, each bar leg 88 has two upper projections 98 and two lower projections 100. A rectangular slot 102 is defined between the upper projections 98 and lower projections 100 on each side of the leg 88. As the legs 88 are too thin to allow a bolt to extend lengthwise therethrough as in conventional thicker screen bars, clamping bars 106 cooperate with the projections 98, 100 to fix the screening bars 28, 30.

All the bars within a single rack are positioned within parallel slots 104 in the retention bracket 94. Rectangular clamping bars 106 run along is the length of the retention bracket 94 and engage within the rectangular slots 102 on each side of the bar legs 88. The clamping bars 106 are positioned on opposite sides of the bar leg 92 and are clamped together with the retention bracket 94 therebetween by bolts 108. The bar retention bracket 94 is fastened by bolts 109 to the bar support beams 70, 80. The bars 106 extend across a number of slots 102 as shown in FIG. 5. In FIG. 2 the clamping bars 106 span one-hird of the bars 28 or across about thirtyseven screening bars. The upper and lower projections 98, 100 lock the legs 88 to the bars 104, thereby fixing the legs 88 to the bracket 94 and to the bar support beams 70, 80.

It should be understood that bar screens of various sizes can be constructed consistent with the disclosure and coming within the scope of the claims.

When used to screen various materials the bar screens 20 will often be used in groups of two, three or more bar screen arranged so the output of one screen feeds the input of subsequent screens. For example two screens may have a horizontal overlap of at least two and one-quarter inches and a vertical spacing of three and one-third inches. When multiple bar screens are used the spacing between bars may be the same between subsequent screens or spacing may be varied between screens.

A typical bar screen 20 may have a dimension across the bars of eleven feet and a dimension along the bars of about 8 feet.

It is understood that the invention is not limited to the particular construction and arrangement of parts herein illustrated and described, but embraces such modified forms thereof as come within the scope of the following claims.

I claim:

1. A bar screen apparatus comprising:

a machine frame;

a first set of parallel bars which define a first rack, each bar of the first set having two depending support legs;

a second set of parallel bars which define a second rack, each bar of the second set having two depending support legs, wherein the bars of the first rack are interleaved with the bars of the second rack, and wherein screening gaps are defined between adjacent interleaved bars;

at least two crank shafts rotatably mounted to the machine frame and positioned under the first and second racks;

two first drive beams which are mounted to the crank shafts in opposed relation;

two first bar support beams which extend between and connect the two first drive beams, wherein each of the bars of the first set of parallel bars is mounted by one of said two depending support legs to each of the two first bar support beams;

two second drive beams which are mounted to the crank shafts in opposed relation; and two second bar support beams which extend between and connect the two second drive beams, wherein each of the bars of the second set of parallel bars is mounted by one of said two depending support legs to each of the two second support beams, and wherein the first and second drive beams are driven by the crank shafts to impart oscillatory motion to the racks.

2. The apparatus of claim 1 wherein the first drive beams are spaced outwardly of the second drive beams and the first bar support beams are offset in spaced parallel relation to the second bar support beams.

3. The apparatus of claim 1 wherein each crank shaft has formed thereon two pairs of axially spaced inner and outer cam surfaces, and wherein the first drive beams are supported on the outer cam surfaces and the second drive beams are supported on the inner cam surfaces.

4. The apparatus of claim 3 wherein each cam surface is a right conic surface which has an axis which is offset from the axis of the crank shaft on which the surface is formed.

5. The apparatus of claim 4 wherein each pair of cam surfaces are offset from one another about the axis of the crank shaft by 180 degrees.

6. The apparatus of claim 1 wherein the two crank shafts comprise a first crank shaft and a second crank shaft and wherein the first crank shaft is driven from a motor and is joined in driving relation to the second crank shaft by a drive belt so all the moving parts of the drive train are joined by mechanical linkages.

7. A bar screen for screening wood chips or waste; comprising:

a machine frame;

a first set of parallel bars which define a first rack, each bar of the first set having two depending support legs;

a second set of parallel bars which define a second rack, each bar of the second set having two depending support legs, wherein the bars of the first rack are interleaved with the bars of the second rack, and wherein screening gaps are defined between adjacent interleaved bars;

a means for causing reciprocating motion positioned beneath the first and second racks;

two first drive beams which are mounted to the means for causing reciprocating motion, the beams being in opposed relation;

two first bar support beams which extend between and connect the two first drive beams, wherein each bar of the first set of parallel bars is mounted by one of said two depending support legs to each of the two first bar support beams;

two second drive beams which are mounted to the means for causing reciprocating motion, the beams being in opposed relation; and two second bar support beams which extend between and connect the two second drive beams, wherein each bar of the second set of parallel bars is mounted by one of said two depending support legs to each of the two second support beams, and wherein the first and second drive beams are driven by the means for causing reciprocating motion to impart oscillatory motion to the racks.

8. A bar screen; comprising:

a machine frame;

a first set of screening bars extending in a machine direction and spaced in a cross machine direction from one another to define a first rack of parallel bars;

a second set of screening bars extending in a machine direction and spaced in a cross machine direction from one another to define a second rack of parallel bars, the first rack of bars being interleaved with the second rack of bars such that screening gaps are defined between the first rack bars and the second rack bars;

a first shaft mounted to the machine frame for rotation about a first axis;

a second shaft mounted to the machine frame for rotation about a second axis, the second shaft being spaced from the first shaft in the machine direction;

a first rack frame extending beneath the first rack and mounted to the first shaft and the second shaft for oscillatory motion, wherein the first rack is fixed to the first rack frame;

a second rack frame extending beneath the second rack and mounted to the first shaft and the second shaft for oscillatory motion, wherein the second rack is fixed to the second rack frame, and wherein each rack frame has at least one counterweight positioned below the first shaft and the second shaft, the counterweights serving to lower the center of gravity of the each combined rack and rack frame to reduce undesirable vibrations in bar screen.

9. The bar screen of claim 8 wherein each shaft has a pair of inner and outer cams on each side of the frame; and wherein the first rack frame is mounted to the inner cams on the first shaft and the second shaft, and the second rack frame is mounted to the outer cams on the first shaft and the second shaft; each cam having a center which is spaced from the axis of the shaft to which it is mounted.

10. The bar screen of claim 9 wherein the center of gravity of each combined rack and rack frame is positioned approximately in a plane extending through the centers of the cams on which said rack frame is mounted.

11. The bar screen of claim 8 wherein the center of gravity of each combined rack and rack frame is positioned approximately in a plane extending through the two shafts.

12. The bar screen of claim 8 wherein each rack frame has two support beams spaced in the machine direction, and the racks are mounted to the support beams, and wherein two drive beams are connected to each support beam, the drive beams extending between the support beams of each rack frame and the drive beams being positioned beneath the shafts and incorporating the counterweights therein, the counterweights serving both to lower the center of mass of the rack frame but also to provide structural stiffness to the rack frame.

13. A screening apparatus comprising:

a machine frame;

a plurality of screening bars extending in a machine direction and spaced in a cross machine direction from one another to define a first rack of parallel bars;

a plurality of screening bars extending in a machine direction and spaced in a cross machine direction from one another to define a second rack of parallel bars, the first rack of bars being interdigitated with the second rack of bars such that screening gaps are defined between the first rack bars and the second rack bars;

a first rack frame extending beneath the first rack and mounted to the machine frame for oscillatory vertical and horizontal motion with respect to the machine frame, wherein the first rack is fixed to the first rack frame;

a second rack frame extending beneath the second rack and mounted to the machine frame for oscillatory vertical and horizontal motion with respect to the machine frame, wherein the second rack is fixed to the second rack frame, and wherein each rack frame has a forward support beam and a parallel rearward support beam which is spaced in the machine direction from the forward support beam, the support beams extending perpendicular to the screening bars and passing beneath the bars in a rack, and wherein each support beam is connected by two downwardly extending posts to two spaced parallel drive beams which extend parallel to the screening bars and connect the forward support beam to the rearward support beam in each rack frame; and a drive which causes the first rack frame and the first rack mounted thereon to oscillate with respect to the frame and the second rack.

14. The apparatus of claim 13 wherein the first rack frame and the second rack frames are mounted to the machine frame by bearings which are positioned along each of the downwardly extending posts, such that the axis of the rotation of the bearings is below the level of the forward support beams and the rearward support beams and above the level of the drive beams.

15. The apparatus of claim 14 the drive beams of the first rack frame and the second rack frame incorporate counterweights to position the center of mass of each rack frame and attached rack at approximately the level of the bearing axes.

16. The apparatus of claim 13 wherein the thickness of each screening bar in the direction perpendicular to the machine direction is approximately one quarter inch.

17. The apparatus of claim 13 wherein the machine frame further comprises:

two inner members which are parallel and spaced from one another in a direction perpendicular to the machine direction; and an outer member spaced outwardly and parallel to each of the inner members.

18. The apparatus of claim 17 wherein the downwardly extending posts of each rack frame include two forward posts and two rearward posts, and further comprising:

two bearings positioned on each of the machine frame two inner members and the machine frame outer members, the bearings being positioned in the machine direction intermediate between a downwardly extending post of the first rack frame and a downwardly extending post of a second rack frame;

forward and rearward rack frame bearings connected to each of the downwardly extending posts of the first rack frame and the second rack frame;

a forward shaft which extends between the bearings connected to the machine frame members, the forward shaft extending through the rack frame bearings mounted to the forward posts of the first rack frame and the second rack frame; and a rearward shaft which extends between the bearings connected to the machine frame members in a position spaced in the machine direction from the forward shaft, the rearward shaft extending through the rack frame bearings mounted to the rearward posts of the first rack frame and the second rack frame, the rack frames being thereby supported on the forward shaft and the rearward shaft.

19. The apparatus of claim 18 wherein the forward shaft and the rearward shaft have cranks with offset portions on which the rack frame bearing ride to cause the first rack frame to oscillate out of phase with the second rack frame.

20. The apparatus of claim 18 one of the forward shaft and the rearward shaft is driven from a motor and is joined in driving relation to the other shaft by a timing belt.

21. A bar screen for screening wood chips or waste; comprising:

a machine frame;

a first set of parallel bars which define a first rack, each bar of the first set having two depending support legs;

a second set of parallel bars which define a second rack, each bar of the second set having two depending support legs, wherein the bars of the first rack are interleaved with the bars of the second rack, and wherein screening gaps are defined between adjacent interleaved bars, and wherein a machine direction is defined substantially parallel to the direction which the parallel bars extend, and a cross machine direction is defined perpendicular to the machine direction;

a first crank shaft and a second crank shaft rotatably mounted to the machine frame, wherein the first crank shaft is spaced from the second crank shaft in the machine direction and the crank shafts are positioned under the first rack and the second rack;

two first drive beams extending beneath the first rack and the second rack, wherein each first drive beam extends between and is connected to the first crank shaft and the second crank shaft, the two first drive beams being spaced from one another in the cross machine direction;

two first bar support beams which extend in the cross machine direction and connect the two first drive beams, the two first bar support beams being spaced from one another in the machine direction, wherein each of the bars of the first set of parallel bars is mounted by one of said two depending support legs to each of the two first bar support beams;

two second drive beams, wherein each second drive beam extends between and is connected to the first crank shaft and the second crank shaft, the two second drive beams being spaced from one another in the cross machine direction; and two second bar support beams which extend in the cross machine direction and connect the two second drive beams, the two second bar support beams being spaced from one another in the machine direction, wherein each of the bars of the second set of parallel bars is mounted by one of said two depending support legs to each of the two second bar support beams, and wherein the first and second drive beams are driven by the crank shafts to impart oscillatory motion to the racks.

* * * * *